US007721774B2

(12) United States Patent
Cook et al.

(10) Patent No.: US 7,721,774 B2
(45) Date of Patent: May 25, 2010

(54) FILLING DEVICE FOR USE WITH A CONTAINER

(75) Inventors: Matthew R. Cook, Hinsdale, IL (US); John Schwan, South Barrington, IL (US); Paul Petriekis, Palos Park, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 409 days.

(21) Appl. No.: 11/641,927

(22) Filed: Dec. 18, 2006

(65) Prior Publication Data

US 2008/0142114 A1 Jun. 19, 2008

(51) Int. Cl.
*B65B 39/00* (2006.01)

(52) U.S. Cl. ..... 141/340; 141/331; 141/333; D7/700

(58) Field of Classification Search ..... 141/331–345; D7/700

See application file for complete search history.

(56) References Cited

U.S. PATENT DOCUMENTS

| | | | | | |
|---|---|---|---|---|---|
| 2,517,759 | A | * | 8/1950 | Bentzen | 141/340 |
| 4,202,386 | A | * | 5/1980 | Orr | 141/300 |
| 4,494,585 | A | * | 1/1985 | Waldecker | 141/98 |
| 4,806,902 | A | * | 2/1989 | Gana | 116/228 |
| 4,850,403 | A | * | 7/1989 | Wiese | 141/95 |
| 4,976,297 | A | * | 12/1990 | Peckels | 141/95 |
| 5,086,619 | A | * | 2/1992 | Huang et al. | 62/50.1 |

FOREIGN PATENT DOCUMENTS

JP 06080121 * 3/1994

* cited by examiner

*Primary Examiner*—Timothy L Maust
(74) *Attorney, Agent, or Firm*—Brinks Hofer Gilson & Lione

(57) ABSTRACT

A filling device is disclosed for allowing substances to fill a beverage container. The filling device may direct a flow of liquid into a container. The filling device may have a bowl with a round and a flat portion, a neck, a wall dividing the bowl into sections, and a plurality of fingers at the terminal end of the neck. One section of the filling device may allow the substance to fill the beverage container while the other section allows air to escape.

15 Claims, 4 Drawing Sheets

FILLING DEVICE FOR USE WITH A CONTAINER

BACKGROUND

Consumers frequently purchase ready-made coffee, and other beverages, in bulk beverage containers, such as for the office and catering. A user may fill the bulk beverage container by pouring a beverage through an opening in the container and into the inner lining. Pouring liquids through a bulk beverage container opening may be complicated and in inefficient. For example, the inner lining of the container may be deflated, creating resistance to the efficient flow of beverage. The user may have to frequently pause to allow the beverage to displace the air in the container lining. Pouring the beverage too quickly may cause the beverage to overflow, creating a burn hazard if the beverage is hot.

SUMMARY OF THE INVENTION

A filling device is disclosed, such as a filling device, for directing a flow of liquid into a container. The filling device may have a bowl, a neck, a wall dividing the bowl into multiple sections, and a plurality of fingers located at an end of the neck.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

A filling device, such as a funnel, is disclosed for use with a container. The filling device may provide rapid filling of a container by permitting air to escape during pouring. Vendors may find that efficient container filling expedites service. Consumers may find the expedited service advantageous.

Figure 1:
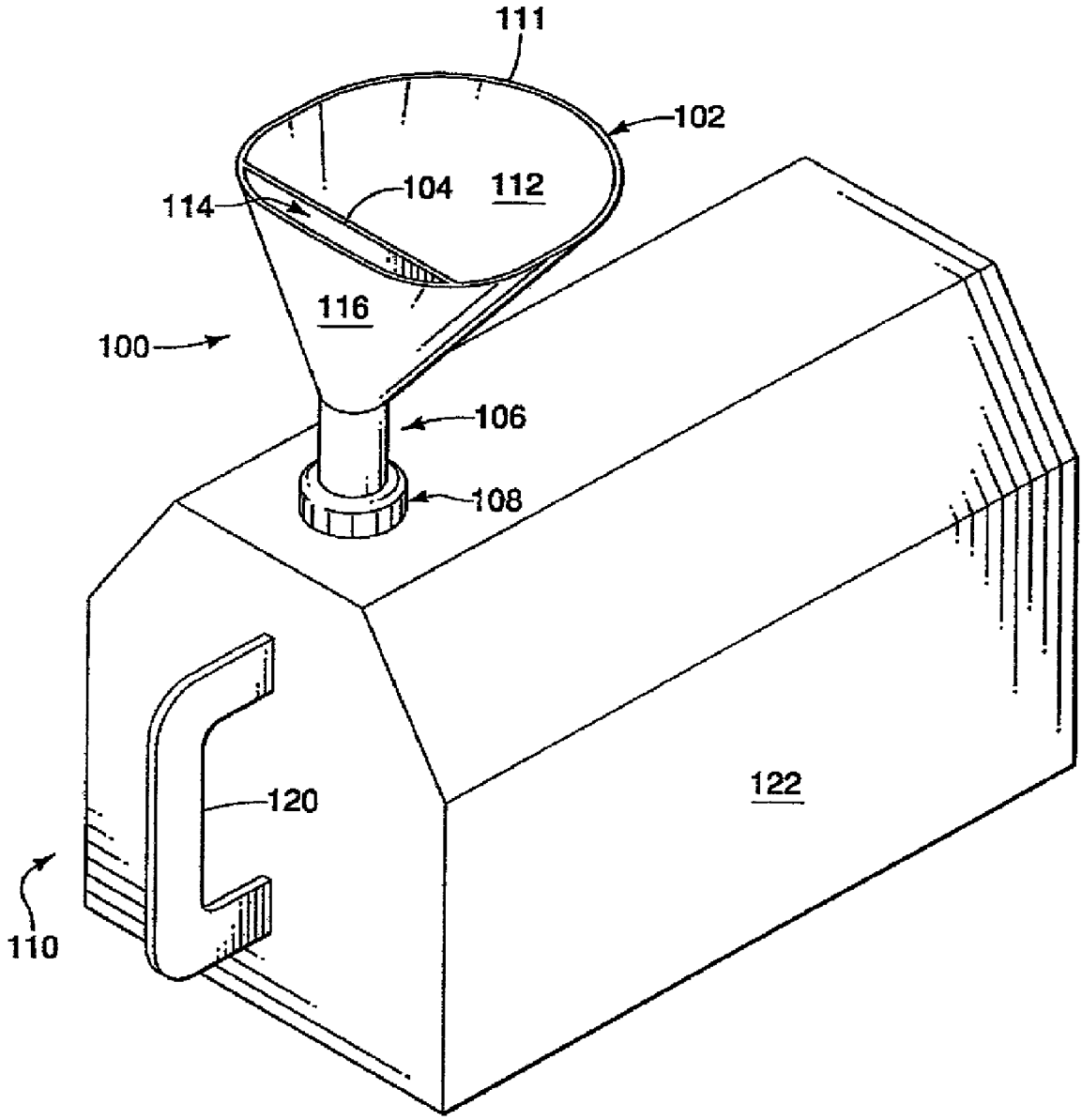
FIG. 1 is perspective view of a filling device and a container.

FIG. 1 illustrates a filling device 100, such as a funnel, which may be used in combination with a container 110, such as a bulk beverage container, or other similar containers. An exemplary container 110 may include an outer shell 122, an inner lining 510 (FIG. 5) (e.g., a bag capable of containing powders, liquids and other substances), an opening 516 (FIG. 5), and a handle 120. The filling device 100 may be used to allow a rapid pouring of the substances, such as beverages, through the opening of a container 110. The filling device 100 may permit an establishment to efficiently and conveniently fill containers 110.

Figure 2:
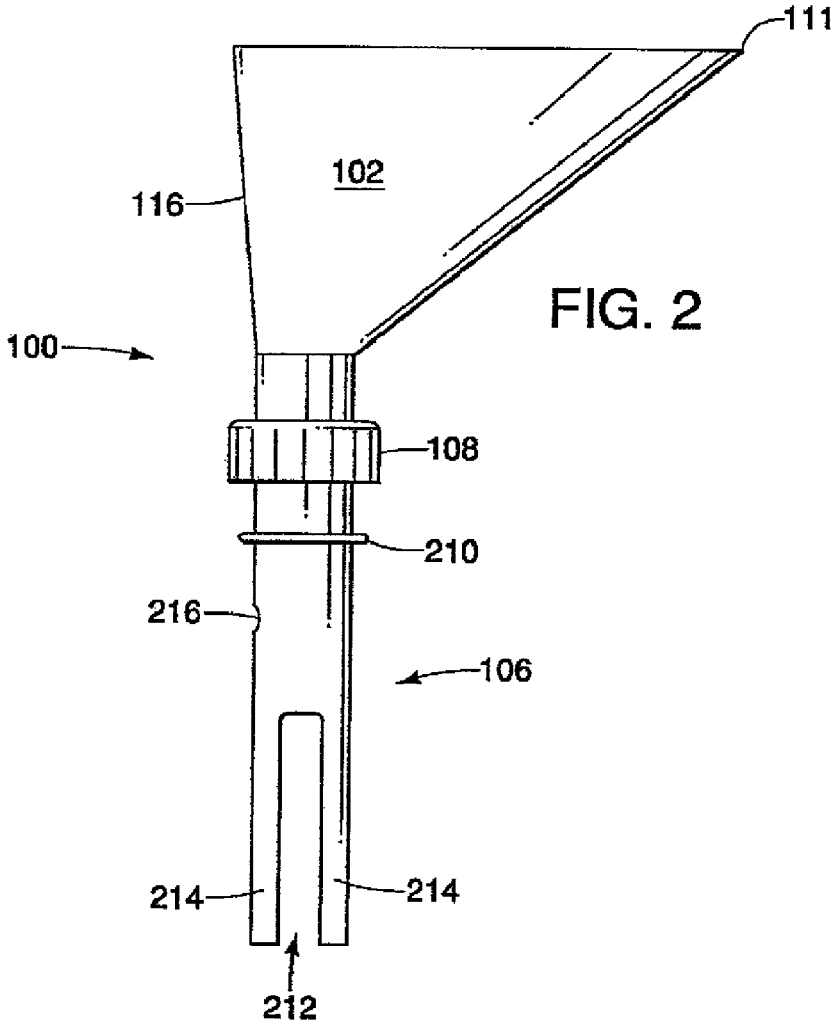
FIG. 2 is a side view of the filling device.

FIG. 2 illustrates a filling device 100 detached from the container 110. The filling device 100 may be formed from any appropriate materials such as plastic, polyethylene, paper, glass, rubber, metal, fiber, or any other material. The filling device 100 may include a bowl 102, having an open mouth 111, a neck 106, and a fitting 108. The bowl 102 may include various shapes, such as by having a round portion 112 and a flat portion 116. Alternatively, the bowl 102 may be completely or partially round, ovular, rectangular, or any other shape such that the bowl 102 can contain the substance when it is being pored into the filling device 100. The sides of the bowl 102 may taper by a constant or varying degree, being widest at the mouth 111, and narrowest at the point where it joins the neck 106.

The bowl 102 may include a wall 104 that divides the mouth 102 into two spaces. A first space 112 may be of sufficient depth and size to accommodate a powder or a liquid, such as a beverage. The first space 112 may be wide, such as to prevent overflow by increasing volume and/or by allowing the user to see when the bag is approaching capacity.

A second space, generally referred to as an air escape passage 114 may be smaller than the first space 112. The air escape passage 114 may allow rapid filling of the substance into the inner lining 510, for example, by allowing air to escape while the substance is being poured via the filling device 100 to the inner lining 510. The second space 112 may allow the user to see when the bag is approaching capacity.

If the bowl 102 has a flat portion 116, it may prevent the filling device 100 from rolling around on a flat surface during storage. For example, the filling device 100 may rest with the flat portion 116 touching a surface and the rounded portion 112 not touching a surface. The flat portion 116 may also prevent the rounded portion 112 from contacting surfaces to help prevent contamination of the portion of the bowl 102 which receives the substances.

The neck 106 may be narrower than the mouth 102 of the filling device 100. The neck 106 may be dimensioned to fit through an opening in a container 110. The neck 106 may have a fitting 108. The fitting 108 may be threaded so as to couple with a container 110 opening. The fitting 108 may also couple with the container opening without threads, such as by snapping on, or other ways. Alternatively, the fitting 108 may not couple with the opening.

The filling device 100 may be open at the mouth 111 and at the terminal end of the neck 106. The neck 106 of the filling device 100 may have a fitting 108. The neck 106 may also have a flange 210. The flange 210 may retain the fitting 108 on the neck 106 of the filling device 100. The flange 210 may also position the fitting 108 on the opening of a container 110 and may set the insertion depth of the filling device 100. The flange 210 may also form a seal between a filling device 100 and a container 110, for example, but not limited to, a gasket seal. The flange 210 may be manufactured from rubber or include a rubber washer to help seal the filling device 100 to the container 110.

The neck 106 of the filling device 100 may terminate in a plurality of fingers 214, defining a plurality of openings 212. The opening 212 may include various shapes, such as a parabola. Alternatively, the neck 100 may have a plurality of openings 212 otherwise arranged. Alternatively or additionally, the neck 106 may also contain an opening 216 in the wall below the flange 210 but positioned such that it would fall above the container 110 fill line.

Figure 3:
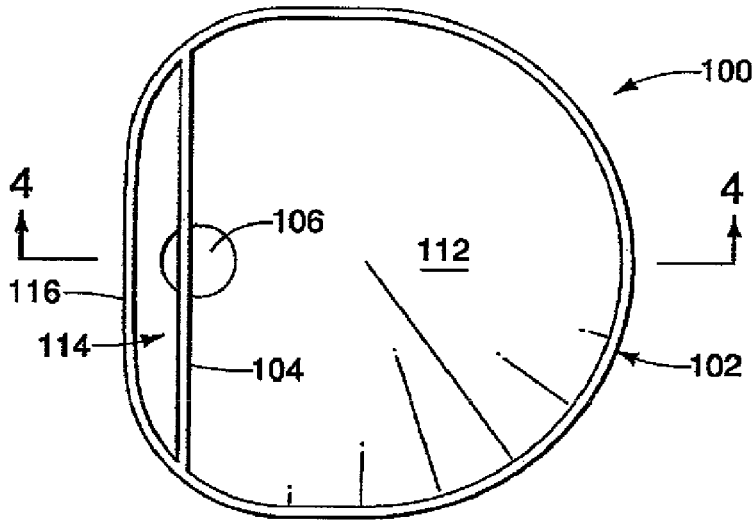
FIG. 3 is a top view of the filling device.

FIG. 3 illustrates a top view looking down through the bowl 102 and neck 106 of the filling device 100 to better show the bisecting wall 104, the liquid chamber 112 and the air escape passage 114. The liquid may contact only the liquid chamber 112 when poured therein.

Figure 4:
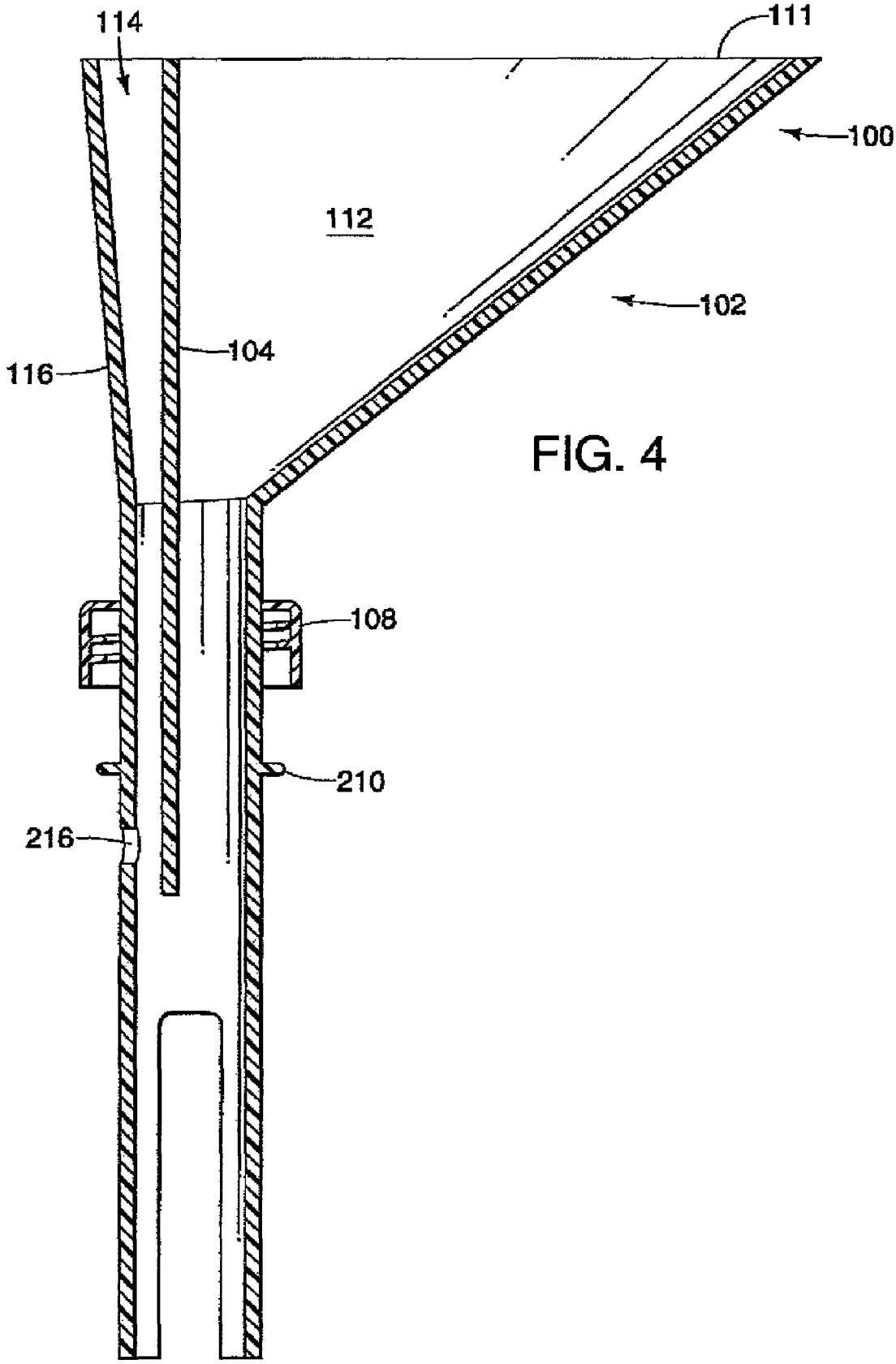
FIG. 4 is a cross-sectional side view of the filling device.

FIG. 4 illustrates a cross-sectional side view of a filling device 100 along line 4-4. The wall 104 dividing the bowl 102 may terminate below the flange 210 but above the container 110 fill line. The wall 104 may extend into the container 110 to a depth approximating the recommended fill level. Positioning the wall 104 above the container 110 fill line may prevent liquid from entering the air escape passage 114 as the container 110 begins reaching capacity. The filling device may also include an air-bypass vent hole 216, for example, positioned above the recommended fill level but inside the container 110. The air-bypass vent hole 216 may allow air to continue entering the air escape 114 as the neck 106 becomes submerged by the substance during container 110 filling.

Figure 5:
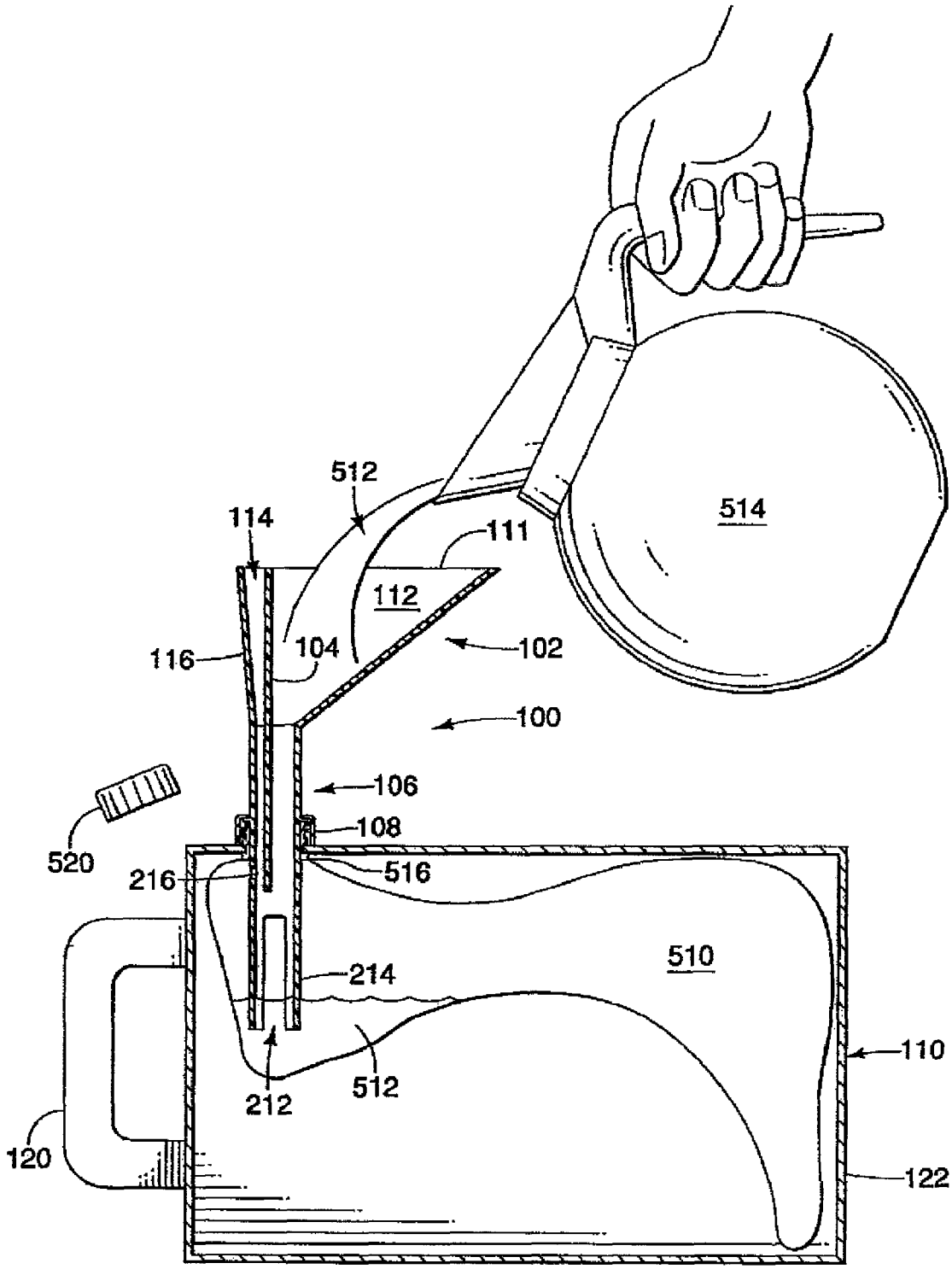
FIG. 5 is a cross-sectional side view of the filling device and a container showing use.

FIG. 5 illustrates a use of the filling device 100. The filling device 100 may be assembled with a container 110 by inserting the neck 106 of the filling device 100 through the opening 516 in the container 110 and the inner liner 510. The opening 516 may include a threaded portion for receiving a fitting 520 to seal the container 110 after filling. The fitting 108 may couple with the threads of the opening 516 to secure the filling device 100 to the container 110. Attaching the filling device 100 to the container 110 may improve pouring safety and may improve efficiency by permitting one person filling.

The inner lining 510 may be deflated or folded within the container shell 122 before being filled by the substance 512. The neck 106 of the filling device 100 may be inserted through the opening 516 in the container 100 and into the lining 510. A plurality of fingers 214 at the terminal end of the neck 106 may force the inner lining 510 open for filling.

A user may fill the container 110 with the substance 512 via the filling device 100. For example, a user may fill the container 110 with hot coffee from a coffee pot 514. The user may pour the substance 512, such as coffee, through the mouth 111 into the larger 112 section of the bowl 102 of the filling device 100. The liquid 512 may travel through the bowl 102 and neck 106 of the filling device into the container lining 510.

The container lining 510 may cling to the terminal end of the filling device neck 106. The spaces 212 between the fingers 214 at the terminal end of the filling device neck 106 may allow the liquid 512 to escape the filling device neck 106 if the terminal end is blocked.

As the container 110 lining 510 fills with liquid 512 and inflates, air may escape through the air escape passage 114 of the filling device 100. Alternatively or additionally, as the liquid level 512 rises and the filling device neck 106 is submerged, air may enter the air escape passage 114 (e.g., formed by a wall extended to the recommended fill line) through a hole 216 in the wall of the filling device neck 106.

While various embodiments of the invention have been described, it will be apparent to those of ordinary skill in the art that many more embodiments and implementations are possible that are within the scope of the invention.

We claim:

1. A filling device for directing a flow of a substance into a container, the filling device comprising:

a bowl;

a neck extending from the bowl;

a fitting on the neck that is slidable about the neck;

a flange on the neck to determine a position of the fitting to the container, wherein the fitting is configured to slide over the flange;

a wall positioned to divide the bowl into a first and second section; and a plurality of fingers at an end of the neck, wherein the neck further includes an opening in a wall of the neck, the opening positioned below the flange and above the plurality of fingers, the opening to allow air to escape from the container into the second section.

2. The filling device of claim 1, wherein the flange comprises a rubber flange.

3. The filling device of claim 1 wherein the flange sets the insertion depth of the filling device neck in the container.

4. The filling device of claim 1, wherein the fitting comprises a snap-on cap.

5. The filling device of claim 1, wherein the fitting comprises a threaded cap.

6. The filling device of claim 5 wherein the threaded fitting attaches to a threaded opening of a beverage container.

7. The filling device of claim 1 wherein the wall extends to a position within the container when the filling device is attached to the container.

8. The filling device of claim 1 wherein the first section accepts a substance.

9. The filling device of claim 8 wherein the second section permits air to be released from the container when the first section includes the substance.

10. The filling device of claim 1, wherein a shape of the bowl comprises a round portion and a flat portion.

11. A filling device for use with a container, the container for holding a substance, the container including an outer shell having an opening, and an inner lining contained within the outer shell, comprising:

a filling device capable of being attached to the outer shell, the filling device including a first section to allow the substance to fill the inner lining and a second section to allow air to escape the filling device while the substance occupies the first section;

a neck extending from the filling device;

a plurality of fingers extending from the neck into the inner lining;

a flange on the neck to determine a position of the filling device on the outer shell of the container;

a fitting on the neck that is configured to slide over the flange;

the neck further including an opening in a wall of the neck, the opening positioned below the flange and above the plurality of fingers, the opening to allow air to escape from the container into the second section of the filling device.

12. The filling device of claim 11 wherein the fitting and the opening are threaded to accommodate a secure fit of the filling device to the outer shell.

13. The filling device of claim 11 wherein the filling device includes a bowl.

14. The filling device of claim 13 wherein the bowl includes a flat portion and a round portion.

15. The filling device of claim 11 wherein the first section and the second section extend into the container when the filling device is attached to the container.

* * * * *